US010080081B1

(12) United States Patent
Zhang

(10) Patent No.: US 10,080,081 B1
(45) Date of Patent: Sep. 18, 2018

(54) MULTIFUNCTIONAL SPEAKER

(71) Applicant: AAC Technologies Pte, Ltd., Singapore (SG)

(72) Inventor: Guqing Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/822,875

(22) Filed: Nov. 27, 2017

(30) Foreign Application Priority Data

Jun. 30, 2017 (CN) ..... 2017 2 0788998 U

(51) Int. Cl.
*H04R 3/00* (2006.01)

(52) U.S. Cl.
CPC ..... *H04R 3/00* (2013.01)

(58) Field of Classification Search
CPC ..... H04R 3/00
See application file for complete search history.

(56) References Cited

U.S. PATENT DOCUMENTS 6,584,209 B1 * 6/2003 Wang ..... H04R 9/022 381/400
8,379,905 B2 * 2/2013 He ..... H04R 9/046 381/386
2005/0271242 A1 * 12/2005 Kaiya ..... H04R 9/022 381/412
2015/0188398 A1 * 7/2015 Zhang ..... H04R 9/02 310/28
2015/0195632 A1 * 7/2015 Wang ..... H04R 31/006 381/386
2016/0021440 A1 * 1/2016 Zhang ..... H04R 7/00 381/412
2016/0021447 A1 * 1/2016 Cai ..... H04R 9/045 381/345
2016/0021461 A1 * 1/2016 Tang ..... H02K 1/34 381/412
2016/0057541 A1 * 2/2016 Porter ..... H04R 9/025 381/412
2016/0112804 A1 * 4/2016 Xiao ..... H04R 9/025 381/398
2016/0127822 A1 * 5/2016 Zhang ..... H04R 1/288 381/346
2016/0127834 A1 * 5/2016 Kim ..... H04R 9/06 381/394
2016/0165335 A1 * 6/2016 Goossens ..... H04R 31/00 381/351

* cited by examiner

*Primary Examiner* — Olisa Anwah
(74) *Attorney, Agent, or Firm* — Na Xu; IPro, PLLC

(57) ABSTRACT

A multifunctional speaker includes a frame with an accommodation space; a magnetic circuit system suspended in the accommodation space by the spring plate; a spring plate connected with the frame, one end of the spring plate being fixed at the frame, the other end of the spring plate being fixed at the side wall; and a annular rear cover attached to an end of the frame. The magnetic circuit system includes a magnetic bowl and a magnetic body supported by the magnetic bowl. The magnetic bowl includes a baseplate fixedly connected with the magnetic body and a side wall formed by bending from an edge of the baseplate. A gap is formed between the periphery of the baseplate and the annular rear cover, and the gap has a width between 0.05 and 0.20 mm.

14 Claims, 3 Drawing Sheets

MULTIFUNCTIONAL SPEAKER

FIELD OF THE PRESENT DISCLOSURE

The present disclosure relates to electro-acoustic transducers, more particularly to a multifunctional speaker.

DESCRIPTION OF RELATED ART

With the rapid development of mobile communication technology in recent years, consumers are using communication equipment with voice functions more and more, such as portable phones, handheld game consoles, portable computers, laptop computers, multimedia players and other devices that can communicate through public or private communication networks. In related art, the multifunctional speaker used in related devices comprises a frame, a vibration system, a magnetic circuit system and a spring plate, in which, the magnetic circuit system is suspended in the accommodation space of the frame with the help of the spring plate. The magnetic circuit system comprises a magnetic bowl and a magnetic body component, the magnetic body component is accommodated in the magnetic bowl and forms with the magnetic bowl a magnetic gap. The vibration system comprises a diaphragm and a voice coil, one end of the voice coil is provided in the magnetic gap, the other end is fixed at the diaphragm. The service life of the speakers is directly related to the structure stability of the existing multifunctional speakers, and the speakers often fail due to accidental drop.

Therefore it is necessary to provide an improved multifunctional speaker for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
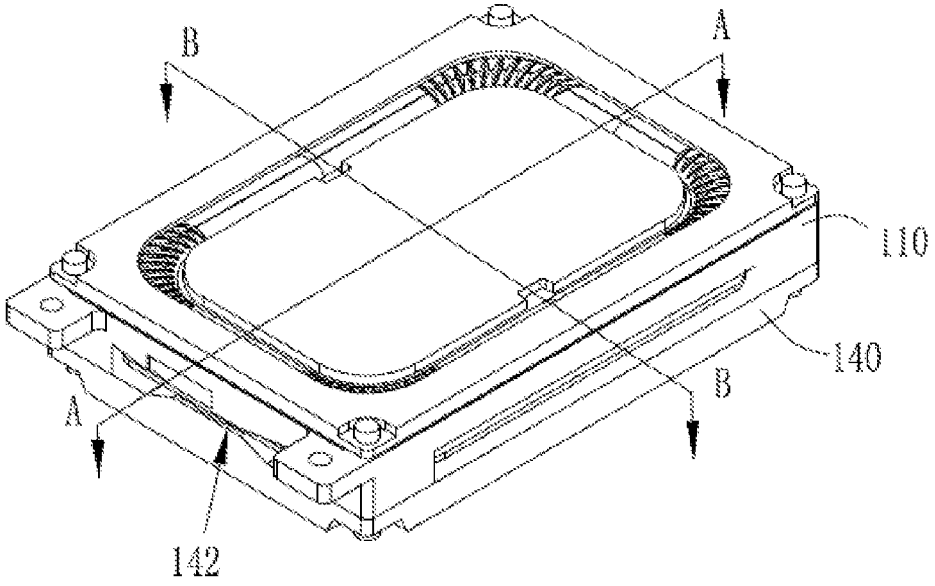
FIG. 1 is an isometric view of a multifunctional speaker in accordance with an exemplary embodiment of the present disclosure.
Figure 5:
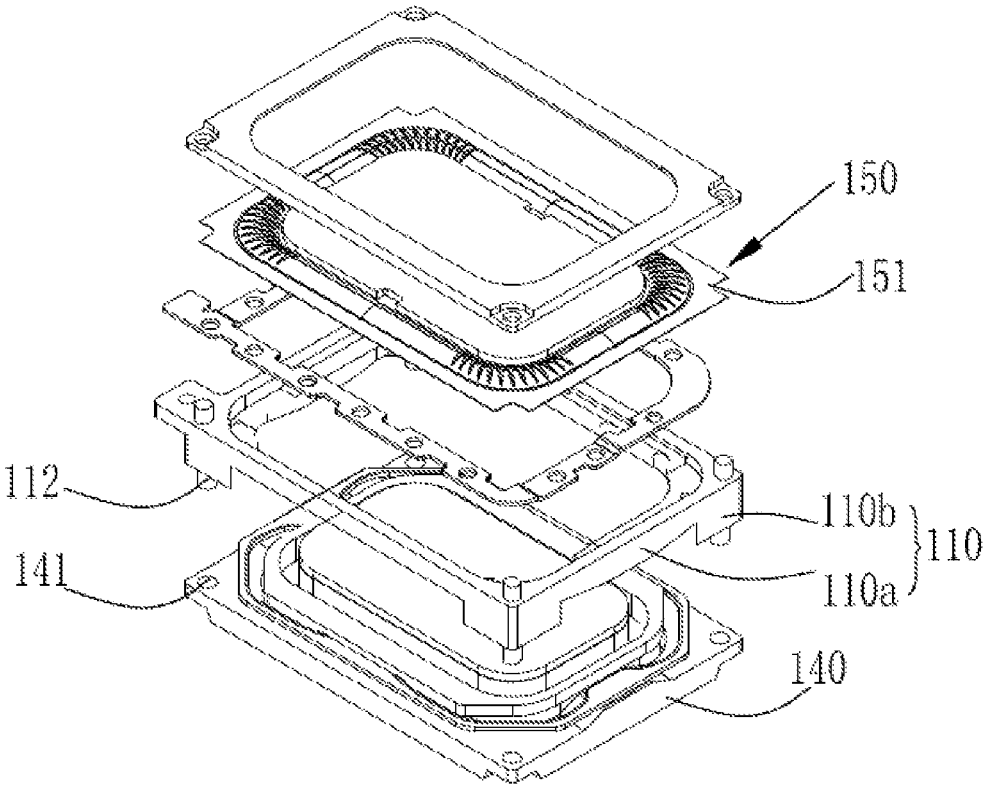
FIG. 5 is an exploded view of the multifunctional speaker.
Figure 6:
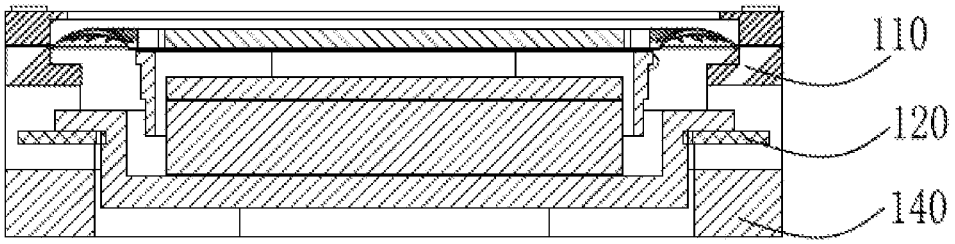
FIG. 6 is a cross-sectional view of the multifunctional speaker in FIG. 1, taken along line B-B.

This disclosure relates to a multifunctional speaker integrating three functions in one. The speaker is a frequencyselection type three-in-one device, and can realize vibration and/or sound production functions by applying different currents to the coil. As shown in FIG. 1, FIG. 2, FIG. 3, FIG. 4, FIG. 5, and FIG. 6, a multifunctional speaker 100, in accordance with an exemplary embodiment of the present disclosure, comprises a frame 110 with an accommodation space, a spring plate 120 connected with the frame 110 and a magnetic circuit system 130 suspended in the accommodation space by the spring plate 120. The magnetic circuit system 130 comprises a magnetic bowl 131 and a magnetic body 132 provided on the magnetic bowl 131. The magnetic bowl 131 comprises a baseplate 1311 fixedly connected with the magnetic body 132 and a side wall 1312 formed by bending from the edge of the baseplate 1311. The side wall 1312 and the baseplate 1311 form the accommodation part which accommodates the magnetic body 132. One end of the spring plate 120 is fixed at the frame 110, the other end of the spring plate 120 is fixed at the side wall 1312. The end of the frame 110 is connected with an annular rear cover 140, the annular rear cover 140 is provided as wound around the periphery of the baseplate 1311. As shown in FIG. 3, a gap g1 is formed between the periphery of the baseplate 1311 and the annular rear cover 140, the gap g1 is between 0.05 and 0.20 mm, for example, the gap can also be between 0.08 and 0.15 mm. The configuration can decrease drop failure of three in one products. Referring to FIG. 5 and FIG. 1, the frame 110 includes a main body 110*a* and an extending arm 110*b* extending from only a part of the main body 110*a* towards the rear cover 140, with the extending arm 110*b* fixed to the rear cover 140 and the main body 110*a* spaced apart from the rear cover 140, and two adjacent extending arms 110*b* spaced apart from each other. The rear cover 140 includes an upper surface 140*a* close to the extending arm 110*b*, and a protrusion 142 extending from the upper surface 140*a* towards the main body 110*a* and formed between the two adjacent extending arms 110*b*. The spring plate 120 is partially fixed to the protrusion 142 and sandwiched between the main body 110*a* and the protrusion 142. The spring plate 120 is annular, comprising a pair of first arms 120*a* opposite to each other and connecting to the side wall 1312, a pair of second arms 120*b* opposite to each other and fixed to the upper surface 140*a*, and a connecting arm 120*c* connecting the first arm 120*a* and the second arm 120*b*. The first arm 120*a*, the connecting arm 120*c* and the connecting arm 120*b* are linked end-to-end to form the spring plate 120. As shown in FIG. 5, the connecting arm is configured for avoiding the extending arm 110*b*, thus saving the product size and space. The first arm 120*a* is positioned between the main body 110 and the upper surface 140*a* and spaced apart from the main body 110 and the upper surface 140*a* separately.

The baseplate 1311 is a rounded rectangle. A distance between the rounded corners of the baseplate 1311 and the rear cover 140 is greater than or equal to a width of the gap, that is, the distance between the rounded corner R of the baseplate 1311 and the rear cover 140 g2 is greater than or equal to the gap between the straight side of the baseplate 1311 and the rear cover 140 g1.

To make sure that the vibration performance of every direction is consistent, the spring plate 120 is annular and provided as wound around the periphery of the side wall 1312.

The end of the side wall 1312 which is far from the baseplate 1311 has a supporting plate 1313 extending toward the spring plate 120. The inner side of the spring plate 120 has a fixing part 121 which is fixedly connected to the supporting plate 1313 and is extended from the inner side.

The supporting of the magnetic bowl 131 by the spring plate 120 is realized by the fixed connection between the fixing part 121 and the supporting plate 1313.

A supporting column 112 is formed symmetrically at the bottom of the frame 110 in the direction of the rear cover, and a through hole 141 is to formed correspondingly on the rear cover 140 which coordinates with the supporting column 112. The fixing of the rear cover 140 and the frame 110 is realized by respective corresponding of the supporting column 112 and the through hole 141.

Figure 2:
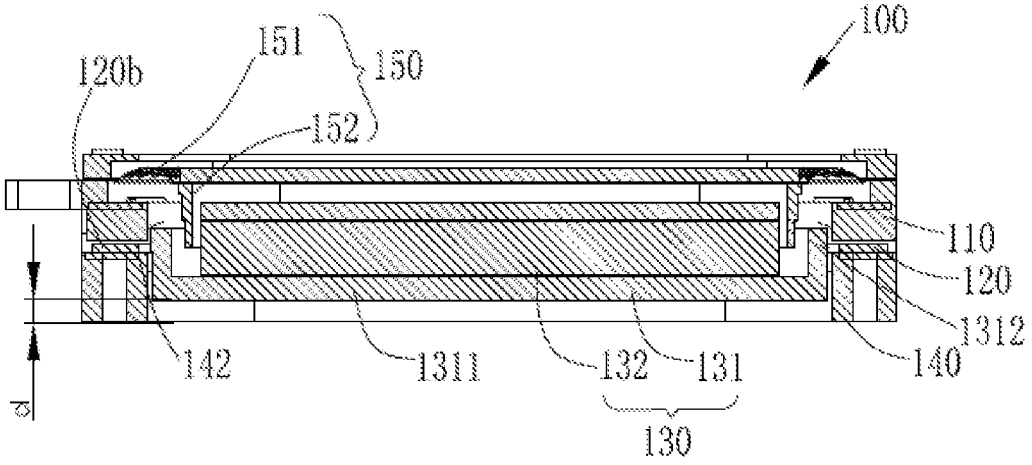
FIG. 2 is a cross-sectional view of the multifunctional speaker in FIG. 1, taken along line A-A.
Figure 3:
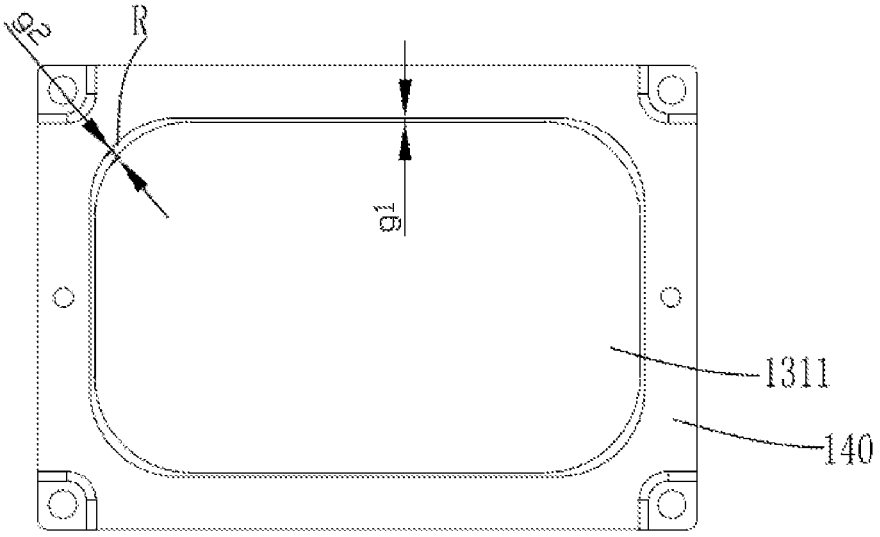
FIG. 3 is a bottom view of the multifunctional speaker.
Figure 4:
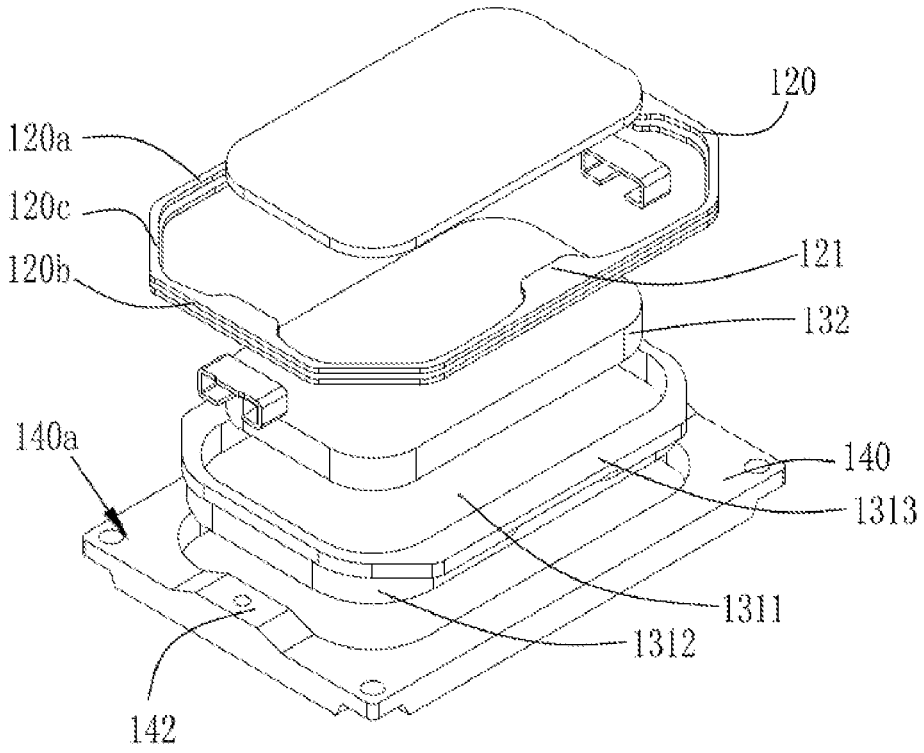
FIG. 4 is an exploded view of a part of the multifunctional speaker.

As shown in FIG. 2, a distance d is defined between the baseplate 1311 and the end face of the rear cover 140 far from the frame 110, and the distance d is greater than or equal to the amplitude of the magnetic bowl 131, through which the collision between the magnetic bowl 131 and other components of a mobile terminal which installs the speaker can be avoided.

The rear cover 140 and the frame 110 in this disclosure are assembled after they are separately molded. In other preferred embodiments of this disclosure, the rear cover 140 and the frame 110 are molded all-in-one.

The multifunctional speaker 100 of this disclosure also comprises a vibration system 150, which is fixed at the side of the frame 110 far from the rear cover 140.

The vibration system 150 comprises a diaphragm 151 which is fixed at the frame 110 and a voice coil 152 which is fixed at the diaphragm 151 and drives the diaphragm 151 to vibrate and produce sounds, and the voice coil 152 is suspended between the magnetic body 132 and the side wall 1312. When the voice coil 152 is electrified, the magnetic body 132 drives the voice coil 152 to vibrate, thereby driving the diaphragm 151 to vibrate and produce sounds.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A multifunctional speaker, including a frame with an accommodation space;

a magnetic circuit system suspended in the accommodation space by the spring plate, the magnetic circuit system including a magnetic bowl and a magnetic body supported by the magnetic bowl;

the magnetic bowl comprising a baseplate fixedly connected with the magnetic body and a side wall formed by bending from an edge of the baseplate;

a spring plate connected with the frame, one end of the spring plate being fixed at the frame, the other end of the spring plate being fixed at the side wall;

a annular rear cover attached to an end of the frame and arranged around a periphery of the baseplate;

a gap formed between the periphery of the baseplate and the annular rear cover, and the gap having a width between 0.05 and 0.20 mm; wherein the frame includes a main body and an extending arm extending from only a part of the main body towards the rear cover, with the extending arm fixed to the rear cover and the main body spaced apart from the rear cover, two adjacent extending arms spaced apart from each other;

the rear cover includes an upper surface close to the extending arm, and a protrusion extending from the upper surface towards the main body and formed between the two adjacent extending arms; and the spring plate is partially fixed to the protrusion and sandwiched between the main body and the protrusion.

2. The multifunctional speaker as described in claim 1, wherein, the baseplate is a rounded rectangle, the distance between the rounded corners of the baseplate and the rear cover is greater than or equal to the width of the gap.

3. The multifunctional speaker as described in claim 1, wherein, the gap has a width between 0.08 and 0.15 mm.

4. The multifunctional speaker as described in claim 1, wherein, the spring plate is annular and arranged around the periphery of the side wall.

5. The multifunctional speaker as described in claim 4, wherein, an end of the side wall far from the baseplate has a supporting plate extending toward the spring plate, the inner side of the spring plate has a fixing part fixedly connected to the supporting plate and is extended from the inner side.

6. The multifunctional speaker as described in claim 5, wherein, a supporting column is formed symmetrically at the bottom of the frame in the direction of the rear cover, and a through hole is formed correspondingly on the rear cover which coordinates with the supporting column.

7. The multifunctional speaker as described in claim 6, wherein, the distance between the baseplate and the end of the rear cover far from the frame is greater than or equal to an amplitude of the magnetic bowl.

8. The multifunctional speaker as described in claim 1, wherein, the rear cover and the frame are molded integrally.

9. The multifunctional speaker as described in claim 1 further including a vibration system fixed at the side of the frame far from the rear cover.

10. The multifunctional speaker as described in claim 9, wherein, the vibration system comprises a diaphragm fixed at the frame and a voice coil fixed at the diaphragm for driving the diaphragm to vibrate, and the voice coil is suspended between the magnetic body and the side wall.

11. The multifunctional speaker as described in claim 1, wherein the spring plate is annular, comprising a pair of first arms opposite to each other and connecting to the side wall, a pair of second arms opposite to each other and fixed to the upper surface, and a connecting arm connecting the first arm and the second arm; the first arm, the connecting arm and the connecting arm are linked end-to-end to form the spring plate.

12. The multifunctional speaker as described in claim 11, wherein the connecting arm is configured to avoid the extending arm.

13. The multifunctional speaker as described in claim 11, wherein, an end of the side wall far from the baseplate has a supporting plate extending toward the spring plate, the inner side of the first arm has a fixing part fixedly connected to the supporting plate and is extended from the inner side.

14. The multifunctional speaker as described in claim 11, wherein, the first arm is positioned between the main body and the upper surface and spaced apart from the main body and the upper surface separately.

* * * * *